US007872631B2

(12) United States Patent
Feng et al.

(10) Patent No.: US 7,872,631 B2
(45) **Date of Patent: *Jan. 18, 2011**

(54) LIQUID CRYSTAL DISPLAY WITH TEMPORAL BLACK POINT

(75) Inventors: Xiao-fan Feng, Vancouver, WA (US); Scott J. Daly, Kalama, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 1038 days.

This patent is subject to a terminal disclaimer.

(21) Appl. No.: 10/966,979

(22) Filed: Oct. 15, 2004

(65) Prior Publication Data

US 2005/0248520 A1 Nov. 10, 2005

Related U.S. Application Data

(60) Provisional application No. 60/568,433, filed on Apr. 5, 2004, provisional application No. 60/570,177, filed on May 11, 2004, provisional application No. 60/589,266, filed on Jul. 19, 2004.

(51) Int. Cl.
*G09G 3/36* (2006.01)

(52) U.S. Cl. ..... 345/102

(58) Field of Classification Search ..... 345/46, 345/87–107, 204, 690, 691; 349/61
See application file for complete search history.

(56) References Cited

U.S. PATENT DOCUMENTS 3,329,474 A 7/1967 Harris et al.
3,375,052 A 3/1968 Kosanke et al.
3,428,743 A 2/1969 Hanlon
3,439,348 A 4/1969 Harris et al.
3,499,700 A 3/1970 Harris et al.
3,503,670 A 3/1970 Kosanke et al.
3,554,632 A 1/1971 Chitayat
3,947,227 A 3/1976 Granger et al.
4,012,116 A 3/1977 Yevick
4,110,794 A 8/1978 Lester et al.
4,187,519 A 2/1980 Vitols et al.
4,384,336 A 5/1983 Frankle et al.
4,385,806 A 5/1983 Fergason (Continued)

FOREIGN PATENT DOCUMENTS

EP 0 732 669 A1 9/1996

(Continued)

OTHER PUBLICATIONS

Kevin L. Russell "Provisional Application For Patent Cover Sheet" May 4, 2004, pp. 1, 3, and 4.*

(Continued)

*Primary Examiner*—Chanh Nguyen
*Assistant Examiner*—Adam J Snyder
(74) *Attorney, Agent, or Firm*—Chemoff, Vilhauer, McClung & Stenzel

(57) ABSTRACT

A backlit display with improved dynamic range. The disclosed display illuminates a pixel of the display at respective non-zero illumination levels during each of a first frame and a second frame and decreases the illumination level of the pixel during the interval between the first frame and the second frame.

17 Claims, 8 Drawing Sheets

U.S. PATENT DOCUMENTS 4,410,238 A 10/1983 Hanson
4,441,791 A 4/1984 Hornbeck
4,516,837 A 5/1985 Soref et al.
4,540,243 A 9/1985 Fergason
4,648,691 A 3/1987 Oguchi et al.
4,649,425 A 3/1987 Pund
4,682,270 A 7/1987 Whitehead et al.
RE32,521 E 10/1987 Fergason
4,719,507 A 1/1988 Bos
4,755,038 A 7/1988 Baker
4,834,500 A 5/1989 Hilsum et al.
4,862,270 A 8/1989 Nishio
4,885,783 A 12/1989 Whitehead et al.
4,910,413 A 3/1990 Tamune
4,917,452 A 4/1990 Liebowitz
4,918,534 A 4/1990 Lam et al.
4,933,754 A 6/1990 Reed et al.
4,954,789 A 9/1990 Sampsell
4,958,915 A 9/1990 Okada et al.
4,969,717 A 11/1990 Mallinson
4,981,838 A 1/1991 Whitehead
4,991,924 A 2/1991 Shankar et al.
5,012,274 A 4/1991 Dolgoff
5,013,140 A 5/1991 Healey et al.
5,074,647 A 12/1991 Fergason et al.
5,075,789 A 12/1991 Jones et al.
5,083,199 A 1/1992 Borner
5,122,791 A 6/1992 Gibbons et al.
5,128,782 A 7/1992 Wood
5,138,449 A 8/1992 Kerpchar
5,164,829 A 11/1992 Wada
5,168,183 A 12/1992 Whitehead
5,187,603 A 2/1993 Bos
5,202,897 A 4/1993 Whitehead
5,206,633 A 4/1993 Zalph
5,224,178 A 6/1993 Madden et al.
5,247,366 A 9/1993 Ginosar et al.
5,256,676 A 10/1993 Hider et al.
5,293,258 A 3/1994 Dattilo
5,300,942 A 4/1994 Dolgoff
5,305,146 A 4/1994 Nakagaki et al.
5,311,217 A 5/1994 Guerin et al.
5,313,225 A 5/1994 Miyadera
5,313,454 A 5/1994 Bustini et al.
5,317,400 A 5/1994 Gurley et al.
5,337,068 A 8/1994 Stewart et al.
5,339,382 A 8/1994 Whitehead
5,357,369 A 10/1994 Pilling et al.
5,359,345 A 10/1994 Hunter
5,369,266 A 11/1994 Nohda et al.
5,369,432 A 11/1994 Kennedy
5,386,253 A 1/1995 Fielding
5,394,195 A 2/1995 Herman
5,395,755 A 3/1995 Thorpe et al.
5,416,496 A 5/1995 Wood
5,422,680 A 6/1995 Lagoni et al.
5,426,312 A 6/1995 Whitehead
5,436,755 A 7/1995 Guerin
5,450,498 A 9/1995 Whitehead
5,456,255 A 10/1995 Abe et al.
5,461,397 A 10/1995 Zhang et al.
5,471,225 A 11/1995 Parks
5,471,228 A 11/1995 Ilcisin et al.
5,481,637 A 1/1996 Whitehead
5,537,128 A 7/1996 Keene et al.
5,570,210 A 10/1996 Yoshida et al.
5,579,134 A 11/1996 Lengyel
5,580,791 A 12/1996 Thorpe et al.
5,592,193 A 1/1997 Chen
5,617,112 A 4/1997 Yoshida et al.
5,642,015 A 6/1997 Whitehead et al.
5,642,128 A 6/1997 Inoue
D381,335 S 7/1997 Whitehead
5,650,880 A 7/1997 Shuter et al.
5,652,672 A 7/1997 Huignard et al.
5,661,839 A 8/1997 Whitehead
5,682,075 A 10/1997 Bolleman et al.
5,684,354 A 11/1997 Gleckman
5,689,283 A 11/1997 Shirochi
5,715,347 A 2/1998 Whitehead
5,717,421 A 2/1998 Katakura et al.
5,717,422 A 2/1998 Fergason
5,729,242 A 3/1998 Margerum et al.
5,748,164 A 5/1998 Handschy et al.
5,751,264 A 5/1998 Cavallerano et al.
5,754,159 A 5/1998 Wood et al.
5,767,828 A 6/1998 McKnight
5,774,599 A 6/1998 Muka et al.
5,784,181 A 7/1998 Loiseaux et al.
5,796,382 A 8/1998 Beeteson
5,809,169 A 9/1998 Rezzouk et al.
5,854,662 A 12/1998 Yuyama et al.
5,886,681 A 3/1999 Walsh et al.
5,889,567 A 3/1999 Swanson et al.
5,892,325 A 4/1999 Gleckman
5,901,266 A 5/1999 Whitehead
5,912,651 A 6/1999 Bitzakidis et al.
5,939,830 A 8/1999 Praiswater
5,940,057 A 8/1999 Lien et al.
5,959,777 A 9/1999 Whitehead
5,978,142 A 11/1999 Blackham et al.
5,986,628 A 11/1999 Tuenge et al.
5,991,456 A 11/1999 Rahman et al.
5,999,307 A 12/1999 Whitehead et al.
6,008,929 A 12/1999 Akimoto et al.
6,024,462 A 2/2000 Whitehead
6,025,583 A 2/2000 Whitehead
6,043,591 A 3/2000 Gleckman
6,050,704 A 4/2000 Park
6,064,784 A 5/2000 Whitehead et al.
6,067,645 A 5/2000 Yamamoto et al.
6,079,844 A 6/2000 Whitehead et al.
6,111,559 A 8/2000 Motomura et al.
6,111,622 A 8/2000 Abilean
6,120,588 A 9/2000 Jacobson
6,120,839 A 9/2000 Comiskey et al.
6,129,444 A 10/2000 Tognoni
6,160,595 A 12/2000 Kishimoto
6,172,798 B1 1/2001 Albert et al.
6,211,851 B1 4/2001 Lien et al.
6,215,920 B1 4/2001 Whitehead et al.
6,232,948 B1 * 5/2001 Tsuchi ..... 345/99
6,243,068 B1 6/2001 Evanicky et al.
6,267,850 B1 7/2001 Bailey et al.
6,276,801 B1 8/2001 Fielding
6,300,931 B1 10/2001 Someya et al.
6,300,932 B1 10/2001 Albert
6,304,365 B1 10/2001 Whitehead
6,323,455 B1 11/2001 Bailey et al.
6,323,989 B1 11/2001 Jacobson et al.
6,327,072 B1 12/2001 Comiskey et al.
RE37,594 E 3/2002 Whitehead
6,359,662 B1 3/2002 Walker
6,377,383 B1 4/2002 Whitehead et al.
6,384,979 B1 5/2002 Whitehead et al.
6,400,436 B1 6/2002 Komatsu
6,414,664 B1 7/2002 Conover et al.
6,418,253 B2 7/2002 Whitehead et al.
6,424,369 B1 7/2002 Adair et al.
6,428,189 B1 8/2002 Hochstein
6,435,654 B1 8/2002 Wang et al.
6,437,921 B1 8/2002 Whitehead
6,439,731 B1 8/2002 Johnson et al.
6,448,944 B2 9/2002 Ronzani et al.

6,448,951 B1 9/2002 Sakaguchi et al.
6,448,955 B1 9/2002 Evanicky et al.
6,452,734 B1 9/2002 Whitehead et al.
6,483,643 B1 11/2002 Zuchowski
6,507,327 B1 1/2003 Atherton et al.
6,545,677 B2 4/2003 Brown
6,559,827 B1 5/2003 Mangerson
6,573,928 B1 6/2003 Jones et al.
6,574,025 B2 6/2003 Whitehead et al.
6,590,561 B1 7/2003 Kabel et al.
6,597,339 B1 7/2003 Ogawa
6,608,614 B1 8/2003 Johnson
6,624,828 B1 9/2003 Dresevic et al.
6,657,607 B1 12/2003 Evanicky et al.
6,680,834 B2 1/2004 Williams
6,690,383 B1 2/2004 Braudaway et al.
6,697,110 B1 2/2004 Jaspers et al.
6,700,559 B1 3/2004 Tanaka et al.
6,753,876 B2 6/2004 Brooksby et al.
6,788,280 B2 * 9/2004 Ham ..... 345/99
6,791,520 B2 9/2004 Choi
6,803,901 B1 10/2004 Numao
6,809,717 B2 * 10/2004 Asao et al. ..... 345/102
6,816,141 B1 11/2004 Fergason
6,816,142 B2 11/2004 Oda et al.
6,816,262 B1 11/2004 Slocum et al.
6,828,816 B2 12/2004 Ham
6,834,125 B2 12/2004 Woodell et al.
6,846,098 B2 1/2005 Bourdelais et al.
6,856,449 B2 2/2005 Winkler et al.
6,862,012 B1 3/2005 Funakoshi et al.
6,864,916 B1 3/2005 Nayar et al.
6,885,369 B2 4/2005 Tanahashi et al.
6,891,672 B2 5/2005 Whitehead et al.
6,900,796 B2 5/2005 Yasunishi et al.
6,932,477 B2 * 8/2005 Stanton ..... 345/46
6,954,193 B1 10/2005 Andrade et al.
6,975,369 B1 12/2005 Burkholder
7,002,546 B1 * 2/2006 Stuppi et al. ..... 345/102
7,113,163 B2 * 9/2006 Nitta et al. ..... 345/102
7,113,164 B1 9/2006 Kurihara
7,123,222 B2 * 10/2006 Borel et al. ..... 345/88
7,161,577 B2 * 1/2007 Hirakata et al. ..... 345/102
7,173,599 B2 * 2/2007 Nishimura ..... 345/102
7,268,759 B2 * 9/2007 Hsu ..... 345/102
2001/0005192 A1 * 6/2001 Walton et al. ..... 345/87
2001/0013854 A1 8/2001 Ogoro
2001/0024199 A1 9/2001 Hughes et al.
2001/0035853 A1 11/2001 Hoelen et al.
2001/0038736 A1 11/2001 Whitehead et al.
2001/0048407 A1 12/2001 Yasunishi et al.
2001/0052897 A1 12/2001 Nakano et al.
2002/0003520 A1 * 1/2002 Aoki ..... 345/87
2002/0003522 A1 1/2002 Baba et al.
2002/0008694 A1 * 1/2002 Miyachi et al. ..... 345/204
2002/0033783 A1 3/2002 Koyama
2002/0036650 A1 3/2002 Kasahara et al.
2002/0044116 A1 * 4/2002 Tagawa et al. ..... 345/87
2002/0057238 A1 5/2002 Nitta et al.
2002/0057253 A1 * 5/2002 Lim et al. ..... 345/102
2002/0063963 A1 5/2002 Whitehead et al.
2002/0067325 A1 6/2002 Choi
2002/0067332 A1 6/2002 Hirakata et al.
2002/0070914 A1 6/2002 Bruning et al.
2002/0093521 A1 7/2002 Daly et al.
2002/0105709 A1 8/2002 Whitehead et al.
2002/0135553 A1 * 9/2002 Nagai et al. ..... 345/89
2002/0149574 A1 10/2002 Johnson et al.
2002/0149575 A1 10/2002 Moon
2002/0154088 A1 10/2002 Nishimura
2002/0159002 A1 * 10/2002 Chang ..... 349/61
2002/0159692 A1 10/2002 Whitehead
2002/0162256 A1 11/2002 Wardle et al.
2002/0171617 A1 11/2002 Fuller
2002/0175907 A1 11/2002 Sekiya et al.
2002/0180733 A1 12/2002 Colmenarez et al.
2002/0190940 A1 * 12/2002 Itoh et al. ..... 345/87
2003/0012448 A1 1/2003 Kimmel et al.
2003/0026494 A1 2/2003 Woodell et al.
2003/0043394 A1 3/2003 Kuwata et al.
2003/0048393 A1 3/2003 Sayag
2003/0053689 A1 3/2003 Watanabe et al.
2003/0072496 A1 4/2003 Woodell et al.
2003/0090455 A1 5/2003 Daly
2003/0107538 A1 6/2003 Asao et al.
2003/0108245 A1 6/2003 Gallagher et al.
2003/0112391 A1 6/2003 Jang et al.
2003/0128337 A1 7/2003 Jaynes et al.
2003/0132905 A1 7/2003 Lee et al.
2003/0142118 A1 * 7/2003 Funamoto et al. ..... 345/691
2003/0169247 A1 9/2003 Kawabe et al.
2003/0179221 A1 * 9/2003 Nitta et al. ..... 345/690
2003/0197709 A1 10/2003 Shimazaki et al.
2004/0012551 A1 1/2004 Ishii
2004/0041782 A1 * 3/2004 Tachibana ..... 345/102
2004/0051724 A1 3/2004 Elliott et al.
2004/0057017 A1 3/2004 Childers et al.
2004/0239587 A1 12/2004 Murata et al.
2004/0263450 A1 12/2004 Lee et al.
2005/0073495 A1 4/2005 Harbers et al.
2005/0088403 A1 4/2005 Yamazaki
2005/0157298 A1 7/2005 Evanicky et al.
2005/0190164 A1 * 9/2005 Velthoven et al. ..... 345/204
2005/0200295 A1 9/2005 Lim et al.
2005/0225561 A1 10/2005 Higgins et al.
2005/0225574 A1 10/2005 Brown et al.
2005/0259064 A1 * 11/2005 Sugino et al. ..... 345/102
2006/0071936 A1 4/2006 Leyvi et al.
2006/0104508 A1 5/2006 Daly et al.
2006/0120598 A1 6/2006 Takahashi et al.
2006/0208998 A1 * 9/2006 Okishiro et al. ..... 345/102
2007/0052636 A1 3/2007 Kalt et al.
2008/0025634 A1 1/2008 Border et al.
2008/0088560 A1 4/2008 Bae et al.

FOREIGN PATENT DOCUMENTS

EP 0829747 3/1998
EP 606162 B1 11/1998
EP 0912047 4/1999
EP 0 963 112 A1 12/1999
EP 1061499 A2 * 12/2000
EP 1168243 1/2002
EP 1 206 130 A1 5/2002
EP 1202244 5/2002
EP 1 313 066 A1 5/2003
EP 1 316 919 A2 6/2003
EP 1 453 002 9/2004
EP 1 453 030 A1 9/2004
FR 2611389 A1 9/1988
GB 2 388 737 11/2003
JP 64-10299 1/1989
JP 01098383 A 4/1989
JP 3-71111 3/1991
JP 3-198026 8/1991
JP 566501 3/1993
JP 5-80716 4/1993
JP 5-273523 10/1993
JP 05289044 A 11/1993
JP 05289044 A5 11/1993
JP 6247623 A 9/1994
JP 6313018 A 11/1994
JP 7-121120 5/1995
JP 9-244548 9/1997
JP 10-508120 8/1998
JP 11052412 2/1999

| | | | |
|---|---|---|---|
| JP | 2002-099250 | | 4/2000 |
| JP | 2000-206488 | | 7/2000 |
| JP | 2000275995 | | 10/2000 |
| JP | 2001-142409 | | 5/2001 |
| JP | 2002091385 | | 3/2002 |
| JP | 2003-204450 | | 7/2003 |
| JP | 2003-230010 | | 8/2003 |
| JP | 3523170 | | 2/2004 |
| JP | 2004-294540 | | 10/2004 |
| KR | 10-2004-0084777 | | 10/2004 |
| TW | 406206 | | 9/2000 |
| WO | WO-91/15843 | | 10/1991 |
| WO | WO 93/20660 | | 10/1993 |
| WO | WO-96/33483 | | 10/1996 |
| WO | WO 98/08134 | | 2/1998 |
| WO | WO-00/75720 | | 12/2000 |
| WO | WO-01/69584 | | 9/2001 |
| WO | WO-02/03687 | | 1/2002 |
| WO | WO-02/079862 | | 10/2002 |
| WO | WO-03/077013 | | 9/2003 |
| WO | WO 03/077013 | A2 * | 9/2003 |
| WO | WO 2004/013835 | | 2/2004 |

OTHER PUBLICATIONS

"49.2: Reduction of LCTV Backlight Power and Enhancement of Gray Scale Capability by Using an Adaptive Dimming Technique" T. Shiga and S. Mikoshiba, SID Symposium Digest 34, 1364 (May 2003), DOI:10.1889/1.1832539.*

Fumiaki Yamada and Yoichi Taira, "An LED backlight for color LCD," IBM Research, Tokyo Research Laboratory, Japan, pp. 363-366, IDW 2000.

T.Funamoto, T.Kobayashi, T.Murao, "High-Picture-Ouality Technique for LCD televisions: LCD-AI," AVC Products Development Center, Matsushita Electric Industrial, Co., Ltd. 1-1 Matsushita-cho, Ibaraki, Osaka 567-0026 Japan. pp. 1157-1158, IDW Nov. 2000.

Fumiaki Yamada, Hajime Hakamura, Yoshitami Sakaguchi, and Yoichi Taira, "52.2: Invited Paper: Color Sequential LCD Based on OCB with an LED Backlight," Tokyo Research Laboratory, IBM Research, Yamato, Kanagawa, Japan, SID 2000 Digest, pp. 1180-1183.

N. Cheung et al., "Configurable Entropy Coding Scheme for H.26L," ITU Telecommunications Standardization Sector Study Group 16, Elbsee, Germany, Jan. 2001.

Paul E. Debevec and Jitendra Malik, "Recovering High Dynamic Range Radiance Maps from Photographs," Proceedings of SIGGRAPH 97, Computer Graphics Proceedings, Annual Conference Series, pp. 369-378 (Aug. 1997, Los Angeles, California). Addison Wesley, Edited by Turner Whitted. ISBN 0-89791-896-7.

Dicarlo, J.M. and Wandell, B. (2000), "Rendering high dynamic range images," in Proc. IS&T/SPIE Electronic Imaging 2000. Image Sensors, vol. 3965, San Jose, CA, pp. 392-401.

Kuang, J., Yamaguchi, H., Johnson, G.M. and Fairchild, M.D. (2004), "Testing HDR image rendering algorithms (Abstract)," in Proc. IS&T/SID Twelfth Color Imaging Conference: Color Science, Systems, and Application, Scottsdale, AR, pp. 315-320.

Durand, F. and Dorsey, J. (2002), "Fast bilateral filtering for the display of high dynamic-range images," in Proc. ACM SIGGRAPH 2002, Annual Conference on Computer Graphics, San Antonia, CA, pp. 257-266.

Kang, S.B., Uyttendaele, M., Winder, S. and Szeliski, R. (2003), "High Dynamic Range Video," ACM Transactions on Graphics 22(3), 319-325.

Brian A. Wandell and Louis D. Silverstein, "The Science of Color," 2003, Elsevier Ltd, Ch. 8 Digital Color Reproduction, pp. 281-316.

Youngshin Kwak and Lindsay W. MacDonald, "Accurate Prediction of Colours on Liquid Crystal Displays," Colour & Imaging Institute, University of Derby, Derby, United Kingdom, IS&T/SID Ninth Color Imaging Conference, pp. 355-359, Date 2001.

A.A.S. Sluyterman and E.P. Boonekamp, "18.2: Architectural Choices in a Scanning Backlight for Large LCD TVs," Philips Lighting, Bld. HBX-p, PO Box 80020, 5600 JM Eindhoven, The Netherlands, SID 05 Digest, pp. 996-999, Date 2005.

Steven L. Wright, et al., "Measurement and Digital compensation of Crosstalk and Photoleakage in High-Resolution TFTLCDs," IBM T.J. Watson Research Center, PO Box 218 MS 10-212, Yorktown Heights, NY 10598, pp. 1-12, date 1996.

* cited by examiner

- Black insertion should be in sync with LCD row driver, at the start of a new frame
- Adjustable duty cycle (Black insertion width) such as 1/2, 1/4, etc.
- Adjustable black level

LIQUID CRYSTAL DISPLAY WITH TEMPORAL BLACK POINT

CROSS-REFERENCE TO RELATED APPLICATIONS

This application claims the benefit of U.S. provisional patent application Ser. Nos. 60/568,433 filed May 4, 2004, 60/570,177 filed May 11, 2004, and 60/589,266 filed Jul. 19, 2004.

BACKGROUND OF THE INVENTION

The present invention relates to backlit displays and, more particularly, to a backlit display with improved dynamic range.

The local transmittance of a liquid crystal display (LCD) panel or a liquid crystal on silicon (LCOS) display can be varied to modulate the intensity of light passing from a backlit source through an area of the panel to produce a pixel that can be displayed at a variable intensity. Whether light from the source passes through the panel to an observer or is blocked is determined by the orientations of molecules of liquid crystals in a light valve.

Since liquid crystals do not emit light, a visible display requires an external light source. Small and inexpensive LCD panels often rely on light that is reflected back toward the viewer after passing through the panel. Since the panel is not completely transparent, a substantial part of the light is absorbed during its transits of the panel and images displayed on this type of panel may be difficult to see except under the best lighting conditions. On the other hand, LCD panels used for computer displays and video screens are typically backlit with fluorescent tubes or arrays of light-emitting diodes (LEDs) that are built into the sides or back of the panel. To provide a display with a more uniform light level, light from these points or line sources is typically dispersed in a diffuser panel before impinging on the light valve that controls transmission to a viewer.

The transmittance of the light valve is controlled by a layer of liquid crystals interposed between a pair of polarizers. Light from the source impinging on the first polarizer comprises electromagnetic waves vibrating in a plurality of planes. Only that portion of the light vibrating in the plane of the optical axis of a polarizer can pass through the polarizer. In an LCD the optical axes of the first and second polarizers are arranged at an angle so that light passing through the first polarizer would normally be blocked from passing through the second polarizer in the series. However, a layer of translucent liquid crystals occupies a cell gap separating the two polarizers. The physical orientation of the molecules of liquid crystal can be controlled and the plane of vibration of light transiting the columns of molecules spanning the layer can be rotated to either align or not align with the optical axes of the polarizers. It is to be understood that normally white may likewise be used.

The surfaces of the first and second polarizers forming the walls of the cell gap are grooved so that the molecules of liquid crystal immediately adjacent to the cell gap walls will align with the grooves and, thereby, be aligned with the optical axis of the respective polarizer. Molecular forces cause adjacent liquid crystal molecules to attempt to align with their neighbors with the result that the orientation of the molecules in the column spanning the cell gap twist over the length of the column. Likewise, the plane of vibration of light transiting the column of molecules will be "twisted" from the optical axis of the first polarizer to that of the second polarizer. With the liquid crystals in this orientation, light from the source can pass through the series polarizers of the translucent panel assembly to produce a lighted area of the display surface when viewed from the front of the panel. It is to be understood that the grooves may be omitted in some configurations.

To darken a pixel and create an image, a voltage, typically controlled by a thin film transistor, is applied to an electrode in an array of electrodes deposited on one wall of the cell gap. The liquid crystal molecules adjacent to the electrode are attracted by the field created by the voltage and rotate to align with the field. As the molecules of liquid crystal are rotated by the electric field, the column of crystals is "untwisted," and the optical axes of the crystals adjacent the cell wall are rotated out of alignment with the optical axis of the corresponding polarizer progressively reducing the local transmittance of the light valve and the intensity of the corresponding display pixel. Color LCD displays are created by varying the intensity of transmitted light for each of a plurality of primary color elements (typically, red, green, and blue) that make up a display pixel.

LCDs can produce bright, high resolution, color images and are thinner, lighter, and draw less power than cathode ray tubes (CRTs). As a result, LCD usage is pervasive for the displays of portable computers, digital clocks and watches, appliances, audio and video equipment, and other electronic devices. On the other hand, the use of LCDs in certain "high end markets," such as medical imaging and graphic arts, is frustrated, in part, by the limited ratio of the luminance of dark and light areas or dynamic range of an LCD. The luminance of a display is a function the gain and the leakage of the display device. The primary factor limiting the dynamic range of an LCD is the leakage of light through the LCD from the backlight even though the pixels are in an "off" (dark) state. As a result of leakage, dark areas of an LCD have a gray or "smoky black" appearance instead of a solid black appearance. Light leakage is the result of the limited extinction ratio of the cross-polarized LCD elements and is exacerbated by the desirability of an intense backlight to enhance the brightness of the displayed image. While bright images are desirable, the additional leakage resulting from usage of a more intense light source adversely affects the dynamic range of the display.

The primary efforts to increase the dynamic range of LCDs have been directed to improving the properties of materials used in LCD construction. As a result of these efforts, the dynamic range of LCDs has increased since their introduction and high quality LCDs can achieve dynamic ranges between 250:1 and 300:1. This is comparable to the dynamic range of an average quality CRT when operated in a well-lit room but is considerably less than the 1000:1 dynamic range that can be obtained with a well-calibrated CRT in a darkened room or dynamic ranges of up to 3000:1 that can be achieved with certain plasma displays.

Image processing techniques have also been used to minimize the effect of contrast limitations resulting from the limited dynamic range of LCDs. Contrast enhancement or contrast stretching alters the range of intensity values of image pixels in order to increase the contrast of the image. For example, if the difference between minimum and maximum intensity values is less than the dynamic range of the display, the intensities of pixels may be adjusted to stretch the range between the highest and lowest intensities to accentuate features of the image. Clipping often results at the extreme white and black intensity levels and frequently must be addressed with gain control techniques. However, these image processing techniques do not solve the problems of light leakage and the limited dynamic range of the LCD and can create imaging problems when the intensity level of a dark scene fluctuates.

Another image processing technique intended to improve the dynamic range of LCDs modulates the output of the backlight as successive frames of video are displayed. If the frame is relatively bright, a backlight control operates the light source at maximum intensity, but if the frame is to be darker, the backlight output is attenuated to a minimum intensity to reduce leakage and darken the image. However, the appearance of a small light object in one of a sequence of generally darker frames will cause a noticeable fluctuation in the light level of the darker images.

What is desired, therefore, is a liquid crystal display having an increased dynamic range.

DETAILED DESCRIPTION OF THE INVENTION

Figure 1:
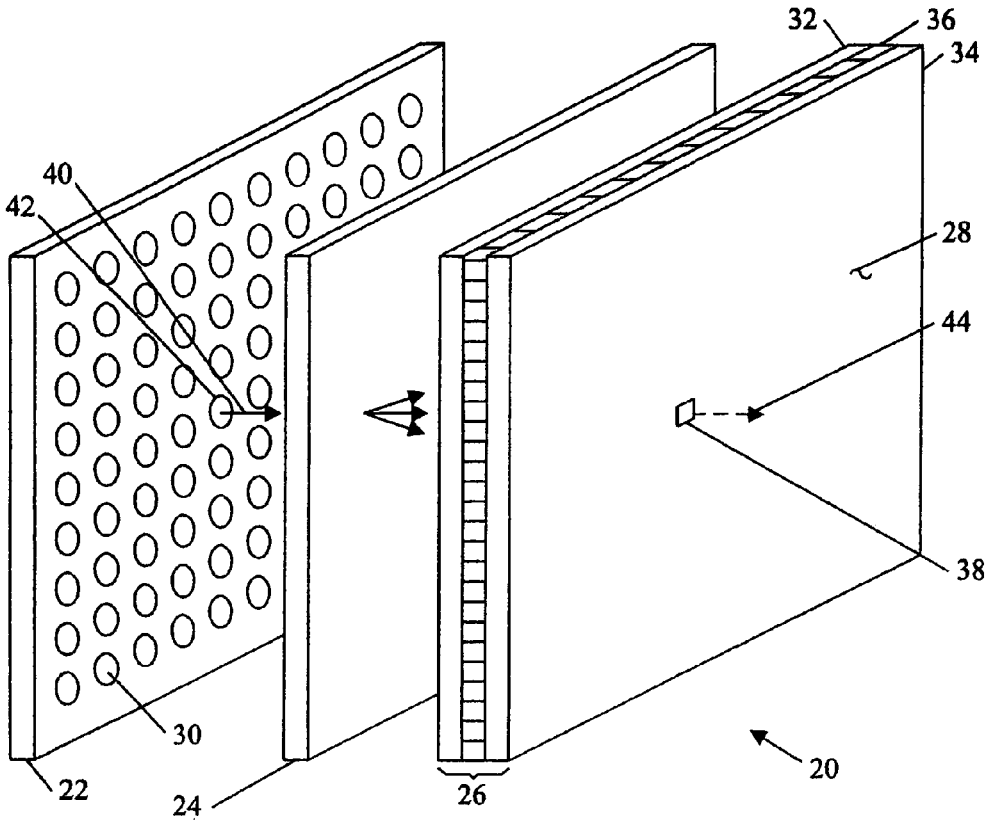
FIG. 1 is a schematic diagram of a liquid crystal display (LCD).

Referring to FIG. 1, a backlit display 20 comprises, generally, a backlight 22, a diffuser 24, and a light valve 26 (indicated by a bracket) that controls the transmittance of light from the backlight 22 to a user viewing an image displayed at the front of the panel 28. The light valve, typically comprising a liquid crystal apparatus, is arranged to electronically control the transmittance of light for a picture element or pixel. Since liquid crystals do not emit light, an external source of light is necessary to create a visible image. The source of light for small and inexpensive LCDs, such as those used in digital clocks or calculators, may be light that is reflected from the back surface of the panel after passing through the panel. Likewise, liquid crystal on silicon (LCOS) devices rely on light reflected from a backplane of the light valve to illuminate a display pixel. However, LCDs absorb a significant portion of the light passing through the assembly and an artificial source of light such as the backlight 22 comprising fluorescent light tubes or an array of light sources 30 (e.g., light-emitting diodes (LEDs)), as illustrated in FIG. 1, is useful to produce pixels of sufficient intensity for highly visible images or to illuminate the display in poor lighting conditions. There may not be a light source 30 for each pixel of the display and, therefore, the light from the point or line sources is typically dispersed by a diffuser panel 24 so that the lighting of the front surface of the panel 28 is more uniform.

Light radiating from the light sources 30 of the backlight 22 comprises electromagnetic waves vibrating in random planes. Only those light waves vibrating in the plane of a polarizer's optical axis can pass through the polarizer. The light valve 26 includes a first polarizer 32 and a second polarizer 34 having optical axes arrayed at an angle so that normally light cannot pass through the series of polarizers. Images are displayable with an LCD because local regions of a liquid crystal layer 36 interposed between the first 32 and second 34 polarizer can be electrically controlled to alter the alignment of the plane of vibration of light relative of the optical axis of a polarizer and, thereby, modulate the transmittance of local regions of the panel corresponding to individual pixels 36 in an array of display pixels.

The layer of liquid crystal molecules 36 occupies a cell gap having walls formed by surfaces of the first 32 and second 34 polarizers. The walls of the cell gap are rubbed to create microscopic grooves aligned with the optical axis of the corresponding polarizer. The grooves cause the layer of liquid crystal molecules adjacent to the walls of the cell gap to align with the optical axis of the associated polarizer. As a result of molecular forces, each succeeding molecule in the column of molecules spanning the cell gap will attempt to align with its neighbors. The result is a layer of liquid crystals comprising innumerable twisted columns of liquid crystal molecules that bridge the cell gap. As light 40 originating at a light source element 42 and passing through the first polarizer 32 passes through each translucent molecule of a column of liquid crystals, its plane of vibration is "twisted" so that when the light reaches the far side of the cell gap its plane of vibration will be aligned with the optical axis of the second polarizer 34. The light 44 vibrating in the plane of the optical axis of the second polarizer 34 can pass through the second polarizer to produce a lighted pixel 28 at the front surface of the display 28.

To darken the pixel 28, a voltage is applied to a spatially corresponding electrode of a rectangular array of transparent electrodes deposited on a wall of the cell gap. The resulting electric field causes molecules of the liquid crystal adjacent to the electrode to rotate toward alignment with the field. The effect is to "untwist" the column of molecules so that the plane of vibration of the light is progressively rotated away from the optical axis of the polarizer as the field strength increases and the local transmittance of the light valve 26 is reduced. As the transmittance of the light valve 26 is reduced, the pixel 28 progressively darkens until the maximum extinction of light 40 from the light source 42 is obtained. Color LCD displays are created by varying the intensity of transmitted light for each of a plurality of primary color elements (typically, red, green, and blue) elements making up a display pixel. Other arrangements of structures may likewise be used.

The dynamic range of an LCD is the ratio of the luminous intensities of brightest and darkest values of the displayed pixels. The maximum intensity is a function of the intensity of the light source and the maximum transmittance of the light valve while the minimum intensity of a pixel is a function of the leakage of light through the light valve in its most opaque state. Since the extinction ratio, the ratio of input and output optical power, of the cross-polarized elements of an LCD panel is relatively low, there is considerable leakage of light from the backlight even if a pixel is turned "off." As a result, a dark pixel of an LCD panel is not solid black but a "smoky black" or gray. While improvements in LCD panel materials have increased the extinction ratio and, consequently, the dynamic range of light and dark pixels, the dynamic range of LCDs is several times less than available with other types of displays. In addition, the limited dynamic range of an LCD can limit the contrast of some images. The current inventor concluded that a factor limiting the dynamic range of LCDs is light leakage when pixels are darkened and that the dynamic range of an LCD can be improved by spatially modulating the output of the panel's backlight to attenuate local luminance levels in areas of the display that are to be darker. The inventor further concluded that combining spatial and temporal modulation of the illumination level of the backlight would further improve the dynamic range of the LCD while limiting demand on the driver of the backlight light sources.

Figure 2:
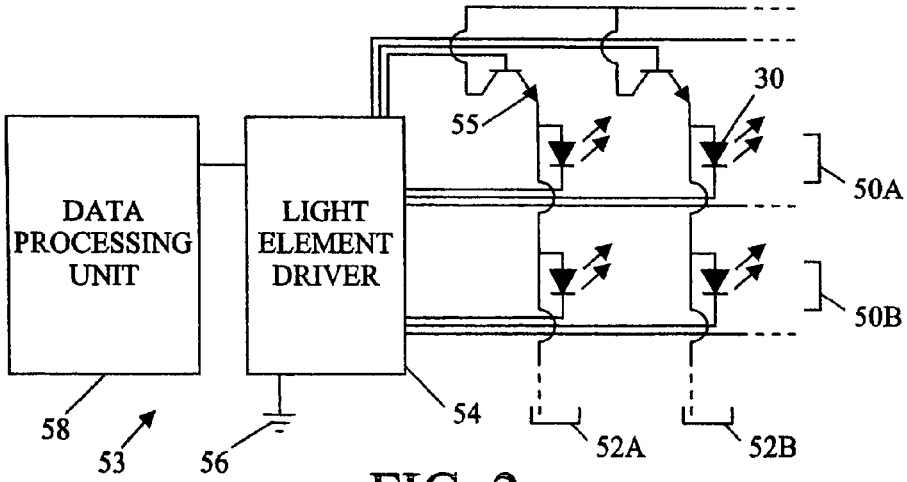
FIG. 2 is a schematic diagram of a driver for modulating the illumination of a plurality of light source elements of a backlight.

In the backlit display 20 with extended dynamic range, the backlight 22 comprises an array of locally controllable light sources 30. The individual light sources 30 of the backlight may be light-emitting diodes (LEDs), an arrangement of phosphors and lensets, or other suitable light-emitting devices. The individual light sources 30 of the backlight array 22 are independently controllable to output light at a luminance level independent of the luminance level of light output by the other light sources so that a light source can be modulated in response to the luminance of the corresponding image pixel. Similarly, a film or material may be overlaid on the backlight to achieve the spatial and/or temporal light modulation. Referring to FIG. 2, the light sources 30 (LEDs illustrated) of the array 22 are typically arranged in the rows, for examples, rows 50*a* and 50*b*, (indicated by brackets) and columns, for examples, columns 52*a* and 52*b* (indicated by brackets) of a rectangular array. The output of the light sources 30 of the backlight are controlled by a backlight driver 53. The light sources 30 are driven by a light source driver 54 that powers the elements by selecting a column of elements 52*a* or 52*b* by actuating a column selection transistor 55 and connecting a selected light source 30 of the selected column to ground 56. A data processing unit 58, processing the digital values for pixels of an image to be displayed, provides a signal to the light driver 54 to select the appropriate light source 30 corresponding to the displayed pixel and to drive the light source with a power level to produce an appropriate level of illumination of the light source.

Figure 3:
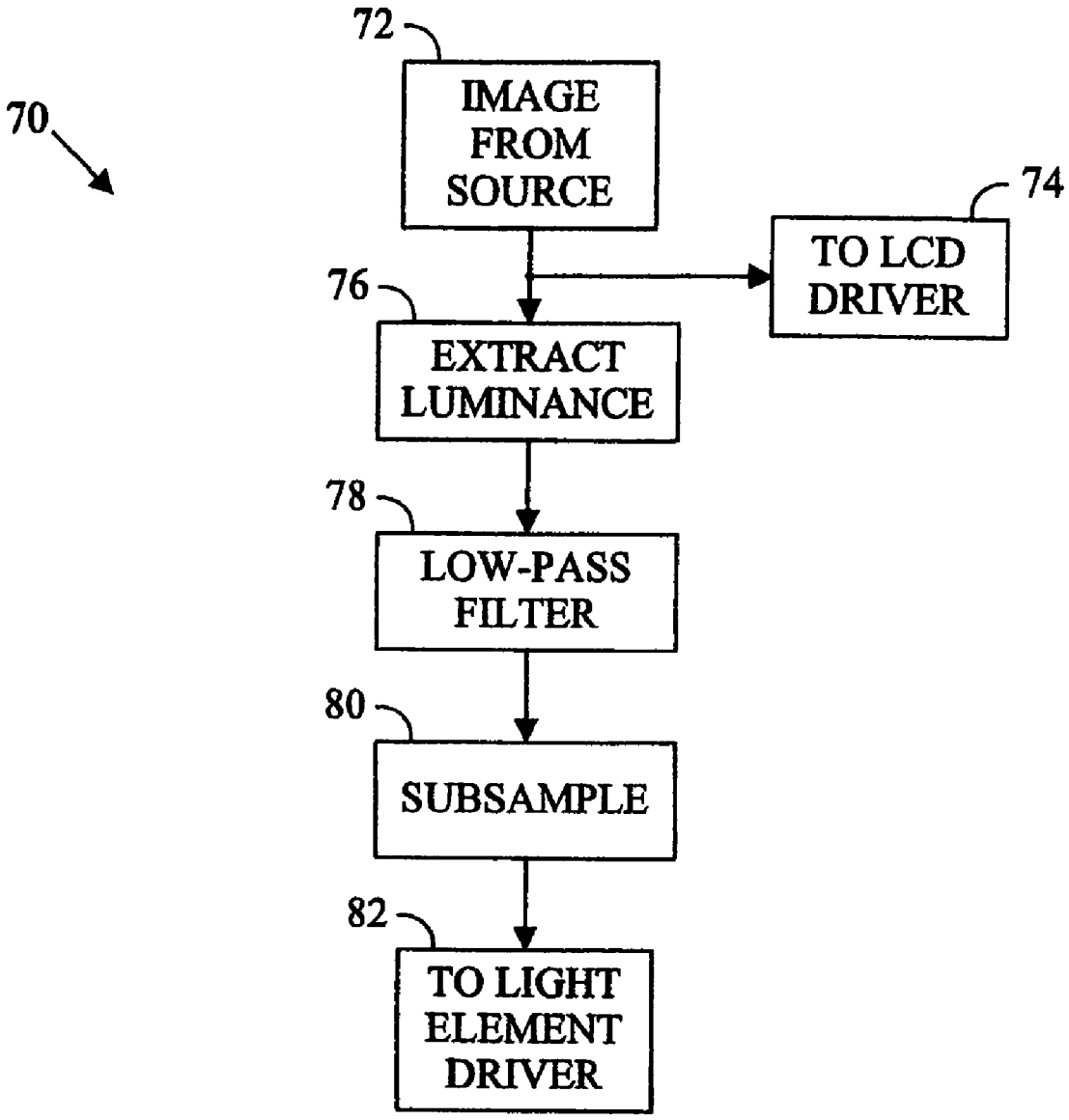
FIG. 3 is a flow diagram of a first technique for increasing the dynamic range of an LCD.

To enhance the dynamic range of the LCD, the illumination of a light source, for example light source 42, of the backlight 22 is varied in response to the desired rumination of a spatially corresponding display pixel, for example pixel 38. Referring to FIG. 3, in a first dynamic range enhancement technique 70, the digital data describing the pixels of the image to be displayed are received from a source 72 and transmitted to an LCD driver 74 that controls the operation of light valve 26 and, thereby, the transmittance of the local region of the LCD corresponding to a display pixel, for example pixel 38.

A data processing unit 58 extracts the luminance of the display pixel from the pixel data 76 if the image is a color image. For example, the luminance signal can be obtained by a weighted summing of the red, green, and blue (RGB) components of the pixel data (e.g., 0.33R+0.57G+0.11B). If the image is a black and white image, the luminance is directly available from the image data and the extraction step 76 can be omitted. The luminance signal is low-pass filtered 78 with a filter having parameters determined by the illumination profile of the light source 30 as affected by the diffuser 24 and properties of the human visual system. Following filtering, the signal is subsampled 80 to obtain a light source illumination signal at spatial coordinates corresponding to the light sources 30 of the backlight array 22. As the rasterized image pixel data are sequentially used to drive 74 the display pixels of the LCD light valve 26, the subsampled luminance signal 80 is used to output a power signal to the light source driver 82 to drive the appropriate light source to output a luminance level according a relationship between the luminance of the image pixel and the luminance of the light source. Modulation of the backlight light sources 30 increases the dynamic range of the LCD pixels by attenuating illumination of "darkened" pixels while the luminance of a "fully on" pixel may remain unchanged.

Figure 4:
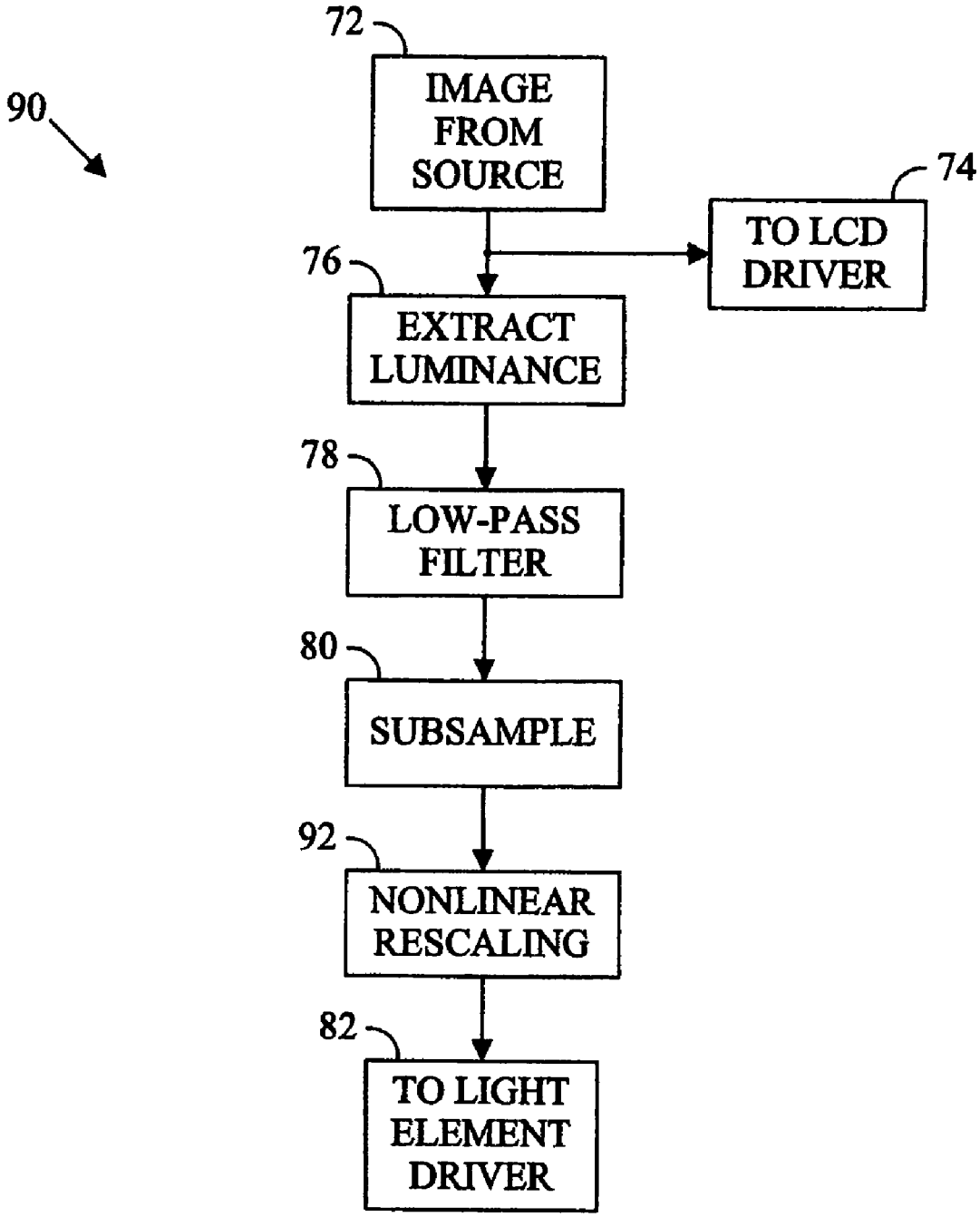
FIG. 4 is a flow diagram of a second technique for increasing the dynamic range of an LCD.

Spatially modulating the output of the light sources 30 according to the sub-sampled luminance data for the display pixels extends the dynamic range of the LCD but also alters the tonescale of the image and may make the contrast unacceptable. Referring to FIG. 4, in a second technique 90 the contrast of the displayed image is improved by resealing the sub-sampled luminance signal relative to the image pixel data so that the illumination of the light source 30 will be appropriate to produce the desired gray scale level at the displayed pixel. In the second technique 90 the image is obtained from the source 72 and sent to the LCD driver 74 as in the first technique 70. Likewise, the luminance is extracted, if necessary, 76, filtered 78 and subsampled 80. However, reducing the illumination of the backlight light source 30 for a pixel while reducing the transmittance of the light valve 28 alters the slope of the grayscale at different points and can cause the image to be overly contrasty (also known as the point contrast or gamma). To avoid undue contrast the luminance subsamples are rescaled 92 to provide a constant slope grayscale.

Likewise, resealing 92 can be used to simulate the performance of another type of display such as a CRT. The emitted luminance of the LCD is a function of the luminance of the light source 30 and the transmittance of the light valve 26. As a result, the appropriate attenuation of the light from a light source to simulate the output of a CRT is expressed by:

$$LS_{attenuation}(CV) = \frac{L_{CRT}}{L_{LCD}} = \frac{\text{gain}(CV + V_d)^{\gamma} + leakage_{CRT}}{\text{gain}(CV + V_d)^{\gamma} + leakage_{LCD}}$$

where:

$LS_{attenuation}(CV)$=the attenuation of the light source as a function of the digital value of the image pixel $L_{CRT}$=the luminance of the CRT display $L_{LCD}$=the luminance of the LCD display $V_d$=an electronic offset $\gamma$=the cathode gamma The attenuation necessary to simulate the operation of a CRT is nonlinear function and a look up table is convenient for use in resealing 92 the light source luminance according to the nonlinear relationship.

Figure 5:
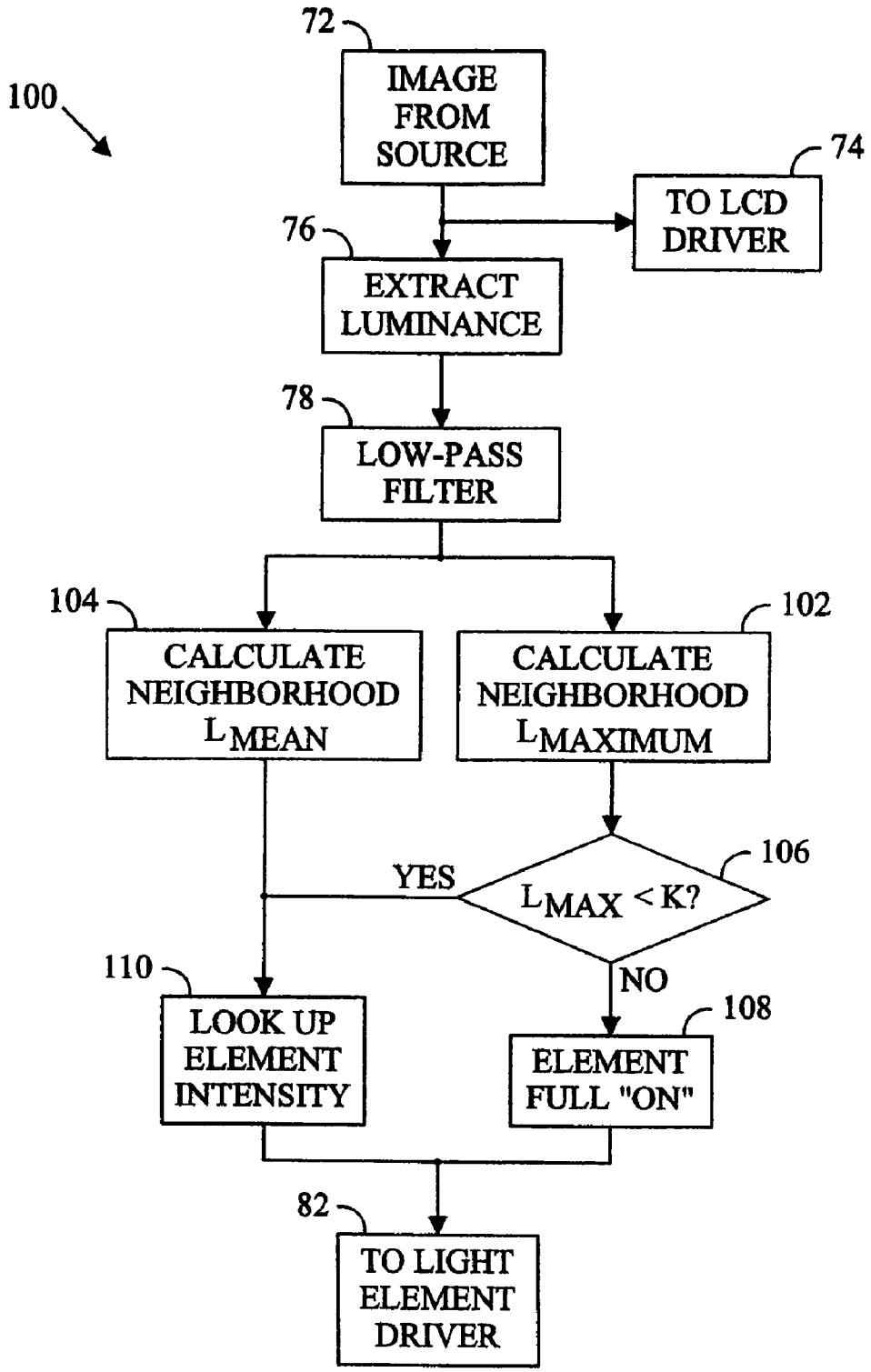
FIG. 5 is a flow diagram of a third technique for increasing the dynamic range of an LCD.

If the LCD and the light sources 30 of the backlight 22 have the same spatial resolution, the dynamic range of the LCD can be extended without concern for spatial artifacts. However, in many applications, the spatial resolution of the array of light sources 30 of the backlight 22 will be substantially less than the resolution of the LCD and the dynamic range extension will be performed with a sampled low frequency (filtered) version of the displayed image. While the human visual system is less able to detect details in dark areas of the image, reducing the luminance of a light source 30 of a backlight array 22 with a lower spatial resolution will darken all image features in the local area. Referring to FIG. 5, in a third technique of dynamic range extension 100, luminance attenuation is not applied if the dark area of the image is small or if the dark area includes some small bright components that may be filtered out by the low pass filtering. In the third dynamic range extension technique 100, the luminance is extracted 76 from the image data 72 and the data is low pass filtered 78. Statistical information relating to the luminance of pixels in a neighborhood illuminated by a light source 30 is obtained and analyzed to determine the appropriate illumination level of the light source. A data processing unit determines the maximum luminance of pixels within the projection area or neighborhood of the light source 102 and whether the maximum luminance exceeds a threshold luminance 106. A high luminance value for one or more pixels in a neighborhood indicates the presence of a detail that will be visually lost if the illumination is reduced. The light source is driven to full illumination 108 if the maximum luminance of the sample area exceeds the threshold 106. If the maximum luminance does not exceed the threshold luminance 106, the light source driver signal modulates the light source to attenuate the light emission. To determine the appropriate modulation of the light source, the data processing unit determines the mean luminance of a plurality of contiguous pixels of a neighborhood 104 and the driver signal is adjusted according to a resealing relationship included in a look up table 110 to appropriately attenuate the output of the light source 30. Since the light distribution from a point source is not uniform over the neighborhood, statistical measures other than the mean luminance may be used to determine the appropriate attenuation of the light source.

The spatial modulation of light sources 30 is typically applied to each frame of video in a video sequence. To reduce the processing required for the light source driving system, spatial modulation of the backlight sources 30 may be applied at a rate less than the video frame rate. The advantages of the improved dynamic range are retained even though spatial modulation is applied to a subset of all of the frames of the video sequence because of the similarity of temporally successive video frames and the relatively slow adjustment of the human visual system to changes in dynamic range.

With the techniques of the present invention, the dynamic range of an LCD can be increased to achieve brighter, higher contrast images characteristic of other types of the display devices. These techniques will make LCDs more acceptable as displays, particularly for high end markets.

The detailed description sets forth numerous specific details to provide a thorough understanding of the present invention. However, those skilled in the art will appreciate that the present invention may be practiced without these specific details. In other instances, well known methods, procedures, components, and circuitry have not been described in detail to avoid obscuring the present invention.

Figure 6:
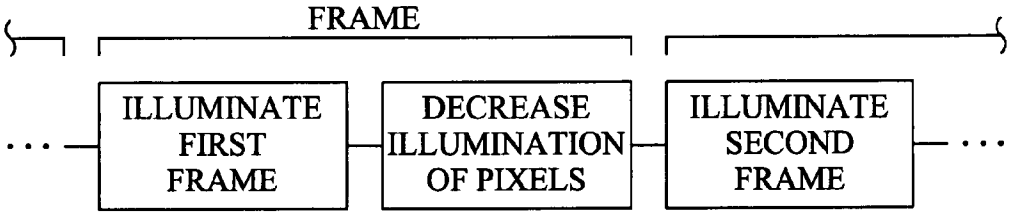
FIG. 6 illustrates a black point insertion technique.

In some liquid crystal displays (LCDs) the backlight is flashed or modulated at the frame rate or a multiple thereof, or otherwise modulated at some interval (which may or may not be a multiple of the frame rate). The benefit of "flashing" the backlight at a rate matching the frame rate is to reduce image blurring due to the hold-type response of typical LCD display usage. The hold-type response of the typical LCD causes a temporal bur whose modulation-transfer-function (MTF) is equal to the Fourier transform of the temporal pixel (i.e. frame) shape. In most LCDs this can be approximated as a rect function. In contrast, the CRT does not have the same temporal MTF degradation since each CRT pixel is essentially flashed for only a millisecond (so the result is temporal MTFs corresponding to 1 ms for CRT and 17 ms for the LCD). However, even if the LCD itself is as fast as the CRT (order of 1 ms), it will still have a temporal response due to the hold-type response, which is due to the backlight being continually on. Referring to FIG. 6, the flashing of the backlight acts to shorten the length of the hold response (e.g., from 17 ms to 8 ms for an approximate 50:50 duty cycle), which essentially doubles the temporal bandwidth (assuming that the LCD blur is nonexistent). The "flashing" backlight may be a reduction of a substantial number of light elements (e.g., greater than 10%, 20%, 50%, 75%, 90%) to a range near zero (e.g., less than 10%, 5% of maximum brightness). In other cases, the light for some of the light elements transitioning between a first level to a greater second level between two adjacent frames is reduced.

Figure 7:
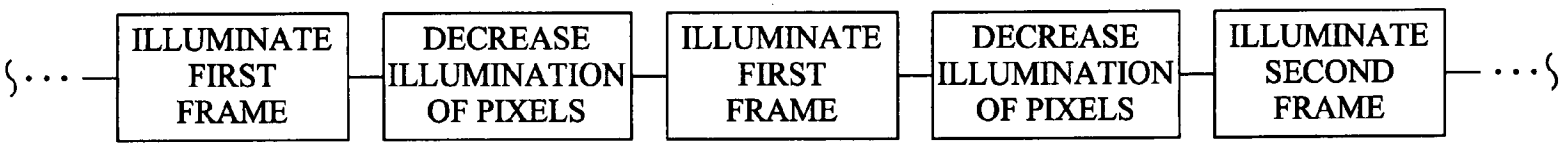
FIG. 7 illustrates another black point insertion technique.

One of the principle drawbacks of "flashing" the backlight is a reduction of brightness from the liquid crystal display. For example, a 50:50 duty cycle for the black point insertion will reduce the brightness, assuming the backlight maximum value is unchanged (usually the case), by approximately half. In addition to reducing the brightness of the display, using such a 50:50 duty cycle black point insertion technique may also result in flickering of images on the display. In order to reduce the amount of flickering that would have otherwise occurred by turning the light elements from "on" to "full off" to "on" is to reduce the level of the black point insertion to a level above completely off (no light). In this manner, instead of the light element being switched completely off, it is switched to a sufficiently low level which is brighter than completely off. Another suitable technique to reduce the amount of flickering that would have otherwise occurred is to perform multiple "flashes" per frame, such as two flashes per frame, as illustrated in FIG. 7. In general, an average rate of more than one flash per frame may be used, if desired. In this manner, the average temporal frequency of the flash is higher than the average temporal frequency of the frame rate and thus less the flickering becomes less visible to the viewer.

Figure 8:
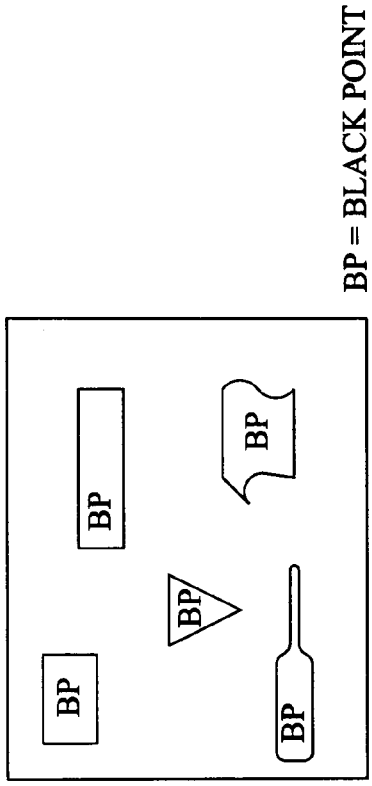
FIG. 8 illustrates spatial regions of a black point insertion technique.

The present inventors also determined that black point insertion is more effective in regions of greater temporal blur as opposed to regions of less temporal blur. Accordingly, the liquid crystal display may include black point insertion in regions having a higher likelihood of temporal blur occurring than in regions having a lower likelihood of temporal blur occurring. In addition, the liquid crystal display may include greater black point insertion (a darker value) in regions having a greater likelihood of temporal blur occurring than in regions having a lower likelihood of temporal blur occurring. In many cases, higher temporal blurring occurs in regions proximate to moving edges of a video stream. Accordingly, in images with relatively low motion such as a still image, in portions of images of a video having little motion, or in the central region of a moving area of a video having low spatial frequency color (e.g. sky), significant (or any) black point insertion may not be necessary. Reducing the amount of black point insertion in regions of the video where the beneficial effects from reduced flickering of black point insertion will be minor results in a liquid crystal display having greater overall brightness. Moreover, due to masking and the mach band effect (which boosts appearance of brightness on the bright side of an edge, and vice versa), the dimmer edge regions due to black point insertion will not be readily apparent. In general, some regions of an image are good candidates for black point insertion and other areas of the image are good candidates for omitting black point insertion. In fact, it turns out for most video there tends to be a reasonably good separation between those regions of each image where back point insertion is highly beneficial and those regions of each image where black point insertion is of relatively little benefit, as illustrated in FIG. 8. Another potential technique for black point insertion may be based upon the content of the image. The content of the image may include, for example, texture, edges with high spatial frequency content, or the amount and type of motion in a video sequence. Also, spatial frequency content and temporal frequency content of a video sequence may be used to set appropriate black point levels for regions of the image. The black point is preferably inserted when there exists both sufficient spatial and temporal frequency in a region.

Figure 9:
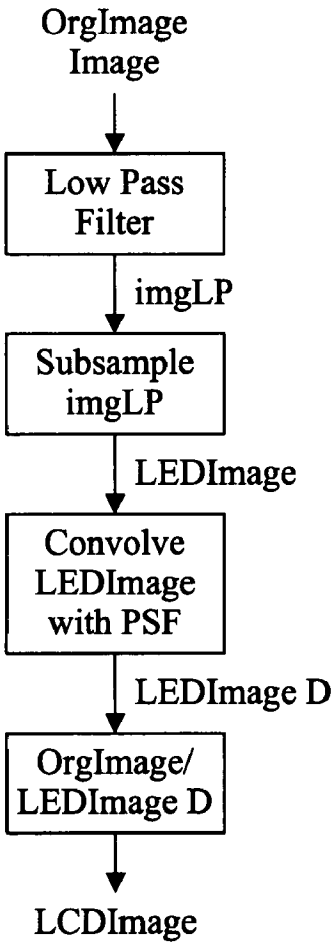
FIG. 9 illustrates a image processing technique suitable for light emitting diodes.

As previously described, the system may include an addressable array of light elements capable of being modulated at an average temporal rate faster than the average temporal frame rate or the rate during which the liquid crystal material may change from "on" to "off". Referring to FIG. 9 the following steps may be included for a LCD-LED combination:

1. Low-pass filter the original "OrgImage" high resolution image resulting in "imgLP";

2. Subsample "imgLP" to the lower resolution of the LED array "LEDImage";

2½. Upsample LEDImage to the original high resolution image;

3. Convolve the "LEDImage" with the PSF (point spread function) of the LED after the diffusion layer to determine LEDImageD;

4. LCD image is given by "OrgImage"/"LEDImageD".

These considerations described above account for the reduction of high frequency aspects of the image, account for the difference in resolution of the original image and the LED array, and account for the effects of the blurring by the diffusion layer. This accounts for the sparseness of the LED array and the higher density of the LCD array to provide the desired output image from the display. In this manner the image from the display may be effectively determined and therefore effective driving of the LED in accordance with the display characteristics may be done. This provides a high dynamic range and can be combined with black point insertion to simultaneously achieve high dynamic range and high fidelity motion rendition. In some circumstances, the modification of the image data may be performed by an image source, such as a personal computer and provided to the display for rendering. However, since each display configuration tends to be unique and maintaining the appropriate image processing software current at each video source is a problematic issue, the conversion techniques for providing data to the liquid crystal material, the light emitting diodes, and the black point insertion levels are preferably performed by a controller integral with the display system.

In an existing system the luminance intensity of the signal is separated in a square root manner so that there is an equal division of the intensity (L-LED*L-LCD transmission) of the input signal. It has been determined by the present inventors that in fact it is preferable to operate the LCD material in a more transmissive manner than a square root function, so that the LED can run during a shorter duration to achieve the same luminance (shorter duty cycle). In this manner there is less motion blur and improved motion rendition. In most cases, the function should include at least 60% transmissive through the LCD and less than 40% for the LED (when based upon the "transmissive"*"LED luminance" to determine total luminance from the display).

In many cases it is desirable to have some additional control over the level of the black point that is inserted on a local or global basis. On the one hand, the insertion of the darkest black point level will tend to reduce the motion blur from the display while tending to increase the amount of observable flicker. On the other hand, the insertion of a lightest black point level will tend to increase the motion blur from the display while tending to reduce the amount of observable flicker. With these observations, it is desirable in some cases to use an average or mean value (or other statistical measure) of the image intensity for a region of the image in order to determine the appropriate black point insertion. It is to be understood that the local level may be spatial and/or temporal in nature. For example, a region $1/8^{th}$ the size of the image may be used as the basis to determine a statistical measure of the corresponding region of the display in order to select an appropriate black point insertion level. Of this region of $1/8^{th}$ the size of the display, all or a portion of the image associated therewith may be used as the basis to determine the statistical measure. Any suitable region of the display may be used as the measure for that region or other regions of the display, where the region is greater than one pixel, and more preferably greater than ½ of the image, and further preferably includes all or a nearly all (greater than 90%) of the image. The system may automatically select the black point insertion levels, or may permit the user to adjust the black point insertion levels (or permit the adjustment of a measure of the flicker and/or a measure of the blur) depending on their particular viewing preferences.

The black point insertion levels may be selected based upon the type of video content, such as a general classification of the video, that is being displayed on the display. For example, a first black point insertion level may be selected for action type video content, and a second black point insertion level may be selected for drama type video content.

The duty cycle may also be selected based upon motion content in the image, such as for video games it is desirable to decrease the "on" duty cycle and decrease the black level to zero. So depending on the motion and spatial frequency content, the duty cycle and black point may be adjusted, either automatically or by a user selection of mode.

The combined LCD-LED system has the capability of sending data to the LED array based on the aforementioned considerations or other suitable considerations. The LCD-LED system may also control the brightness of the LED by using a plurality of subdivisions (temporal time periods or otherwise sub-frames) within the duration of a single frame. In some embodiments, extra data may be used to provide this function, but this data should be provided at the resolution of the LED array (or substantially the same as) (a low frequency signal can be carried on one line of the image for this purpose, if desired). By way of example, if the system has 8 total bits, the system may use 4 bits to control whether each of 4 subdivisions are "on" or "off" while the other 4 bits are used to control the amplitude of the LED for each of the subdivision, thereby providing 16 black point levels. Other combinations of one or more subdivisions and black point levels within each subdivision may likewise be used, as desired. In this example, setting the amplitude to level 16 (maximum brightness) permits the regular modulation of the LED array to occur. The lower amplitude levels result in an increasing reduction in the blackness of the LED; thus resulting in different levels of black-point insertion.

Figure 10:
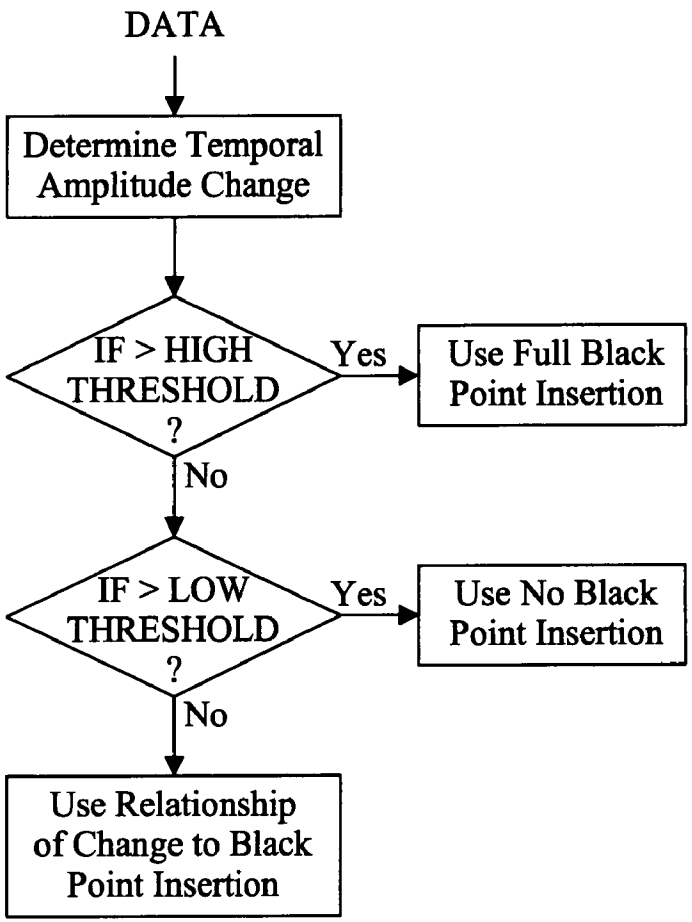
FIG. 10 illustrates the use of threshold in a black point technique.

The additional steps for this black-point insertion example may include, for example (see FIG. 10):

(a) If the temporal change in the amplitude of a given pixel does not sufficiently change (e.g., the temporal change in amplitude is less than a threshold value (fixed or adaptive), then the amplitude of the black point insertion is set to maximum (i.e., no black point insertion).

(b) If the temporal change in the amplitude of a given pixel sufficiently changes (e.g., the temporal change in amplitude is greater than a threshold value (fixed or adaptive), then the amplitude of the black point insertion is set to zero (i.e. full black point insertion).

(c) If the temporal change in the amplitude of a given pixel is sufficiently high (greater than the lower threshold) and sufficiently low (less than the greater threshold), then a relationship between the temporal change and the black point insertion level may be used. This may be a monotonic change, if desired.

Figure 11:
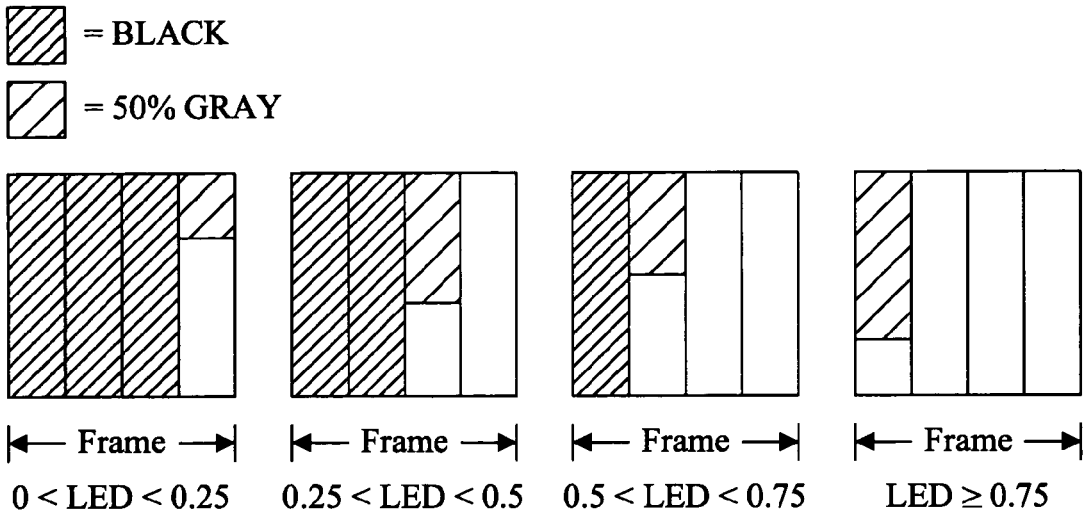
FIG. 11 illustrates a set of black point insertion techniques.

(d) The amplitude of the black point insertion may also be modified over one or more of the temporal sub-frame time periods, as illustrated in FIG. 11. On the leftmost frame 1 of FIG. 11, there is strong black point insertion, and on the rightmost frame 4, there is no black point insertion (reverting to the hold-type with max brightness). Frames 2 and 3 of FIG. 11 have intermediate levels of black point insertion.

Figure 13:
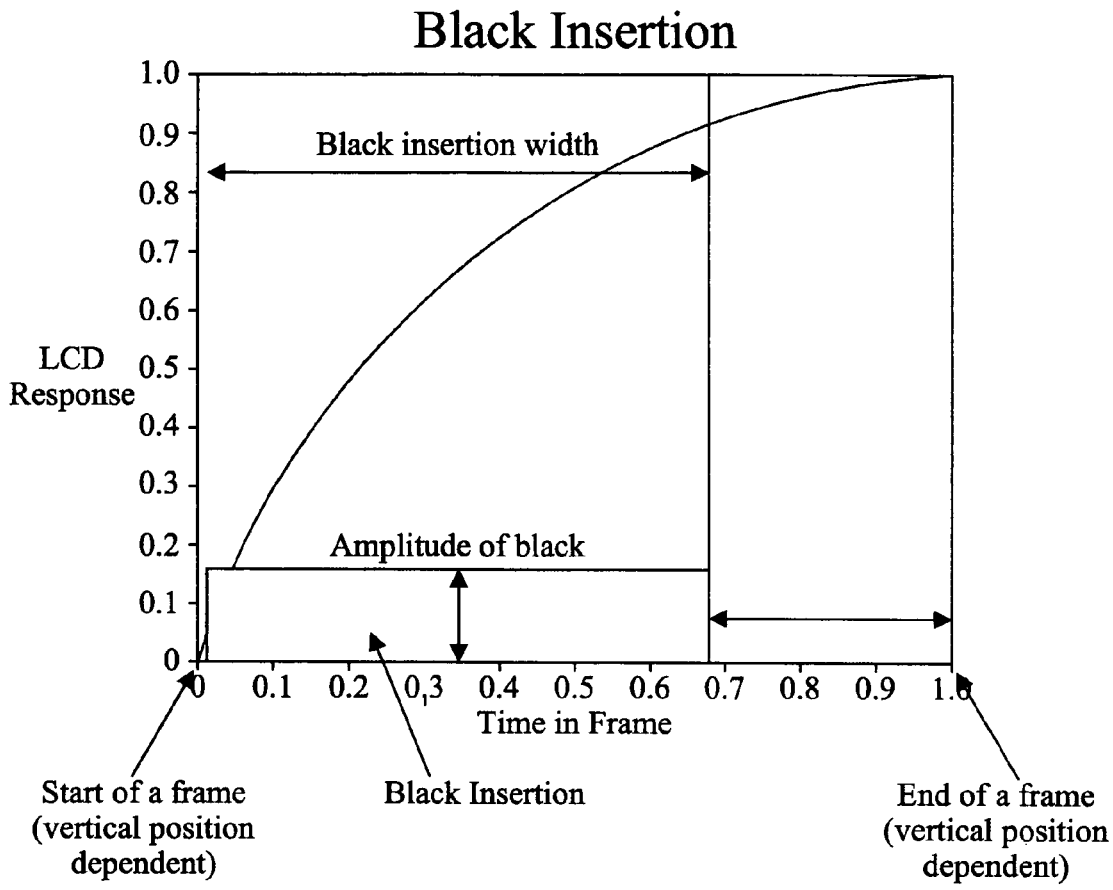
FIG. 13 illustrates black point insertion and synchronization.

In some cases, it is desirable during a sub-frame time period to permit the liquid crystal material to be provided with new image data so that the liquid crystals may start their modification to a new orientation (e.g., level) while maintaining some level of black point insertion, and then after some non-zero time period has elapsed to modify the illumination of the LED array to provide the anticipated image, as illustrated in FIG. 13. Preferably the elapsing time period is greater than $1/10^{th}$ of a frame. In this manner, the image quality may be enhanced by not providing an image during a portion of the transition of the crystals of the liquid crystal material.

In the preferred embodiment, one or more of the aforementioned decisions depending on the particular implementation may be carried out at the temporal resolution of the frame rate, as opposed to the black point insertion rate which may be greater. In other words, the decisions may be determined at a rate less than that of the black point insertion rate. This reduces the computational resources necessary for implementation. The black point insertion patterns may be determined in advance for the different levels of black point insertion used.

Figure 12:
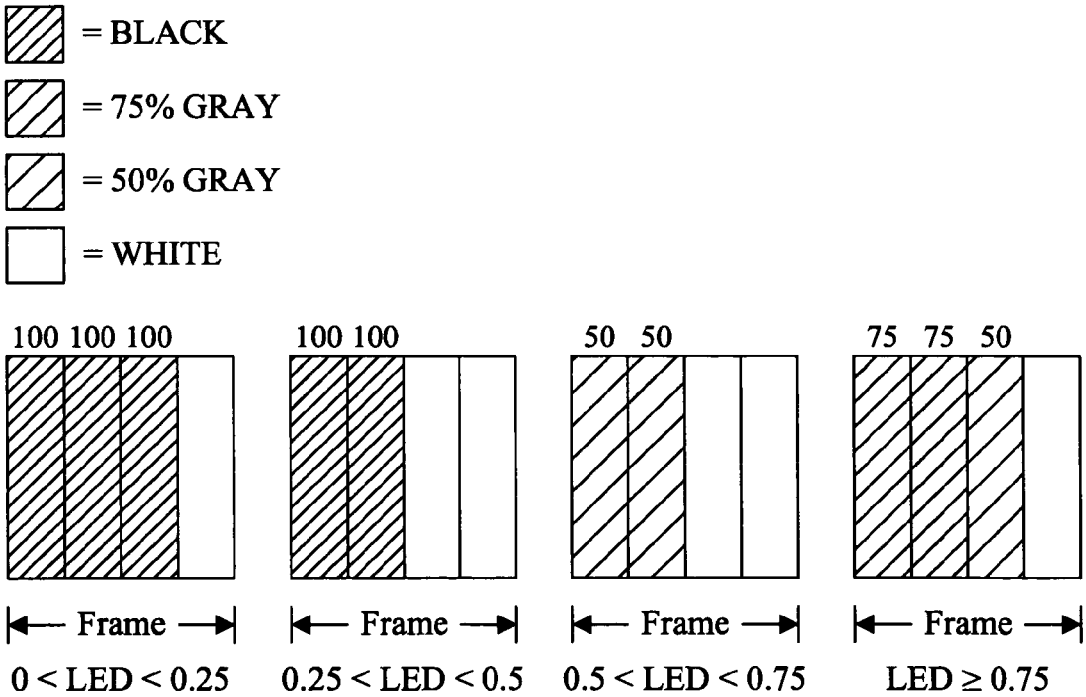
FIG. 12 illustrates another set of black point insertion techniques.

Another embodiment may use the characteristics of the spatial character of regions of the image in order to determine characteristics of the image content. For example, determining spatial characteristics of different regions of the image may assist in determining those regions where the texture is moving (such as a grid pattern moving right to left) and other regions that are moving having relatively uniform content. The characterization of these different types of content are especially useful in the event the display does not include a temporal frame buffer (or a buffer greater than 50% of the size of the image) so that information related to previous frames is known. In addition, the spatial characteristics of the image may be combined with the temporal characteristics of the image, if desired. It is noted that these differences may be obtained from any suitable source, such as the high resolution input image. Further, the use of multiple sub-frames may be used to address the multiple black point insertion during a single frame. For example, the black point insertion may be included on sub-frames 1 and 3, or 2 and 4, with the display illuminated during the other sub-frames, together with varying the amplitudes and/or spatial characteristic considerations. Another modified sequence for black point insertion is illustrated in FIG. 12.

In some cases it is desirable to incorporate an adaptive black point insertion. Using an adaptive black point technique information regarding one or more previous frames and/or one or more future frames to be displayed may be used to adjust the black point. The technique may preferably seek to maintain a relatively high black level in order to preserve the overall brightness of the display. Similarly, the technique may also reduce potential flickering.

For example, the black level may be the minimum of the previous frame or the current frame, or any other suitable measure with a previous frame. The white level may be the (LEDImage−BlackLevel*BlackWidth)/WhiteWidth, or any suitable use of the current image in combination with the BlackLevel and/or the LED characteristics. The "BlackWidth" and the "WhiteWidth" refers to the duration that the black point is inserted or the image is displayed of a frame.

For improved image quality, the black width should be as wide as possible, or the white width should be as narrow as possible to reduce the aperture width during which the image is displayed. However, making the aperture width for the image too small may cause the white level to essentially exceed the maximum white that the LED can provide. Thus the following technique may be used to determine a more optimal black width.

```
while(WhiteLevel>maxWhite)

BlackWidth=BlackWidth+delta

WhiteLevel=(LEDImage−BlackLevel*BlackWidth)/
    WhiteWidth Endloop
```

Delta is a small time interval, such as $1/16^{th}$ of a frame.

The desire is to maximize the white level so that the width of the illumination may be reduced. Accordingly, the black level should be as high as possible so that the white level may be narrowed as much as possible, so that motion blur is reduced.

A modified technique may be used for modification of the black point based upon image content. The preferred technique, merely for purposes of illustration, includes separating the original high resolution input image into a lower resolution LED image and higher resolution LCD image:

1. Low-pass filter the original high resolution image Image(i, j) to form imgLP(i,j)
2. Subsample imgLP(i,j) to the resolution of LED grid LEDImage
3. Convolve the LEDImage(i,j) with the PSF of LED after the diffusion layer LEDImageD(i,j)
4. LCD image is given by $$LCDImage(i,j)=Image(i,j)/LEDImageD(i,j)$$

This technique makes use of information from a previous frame. As previously noted, the black level is preferably as high as possible so that the overall brightness is preserved. It also reduces the flickering as well.

In many cases, the black width may only take some fixed value such ¼, ½, or ¾ of a frame time. When working at the flashing mode, the LED can be driven higher than the continuous mode. Assuming that the LED can overdriven for 25% or more, the following technique, merely for purposes of illustration, may be used to provide a sharper motion image and at the same time, preserve luminance.

$$BlackLevel=1/8^{th} \text{ to } 1/4 \text{ of } (LEDImage(i,j))$$

Where i, j are the index of LED pixel and the subscript 1 denotes the current frame.

```
If    LEDImage1(i,j) < (MaxWhite+3BlackLevel)/4
      WhiteLevel= (LEDImage1(i,j)− BlackLevel*0.75)*4
Else if     LEDImage1(i,j) < (MaxWhite+BlackLevel)/2
      WhiteLevel= (LEDImage1(i,j)− BlackLevel*0.5-0.25*MaxWhite)*4
                                                        WhiteLevel
Else
      WhiteLevel= (LEDImage1(i,j)− BlackLevel*0.25-0.5*MaxWhite)*4
```

In general, it is to be understood that the system may be used for other purposes, where the changes in the illumination from the LED are at a different rate than the LCD, either faster, slower, sometimes faster and sometimes slower, or part of the LEDs are faster and/or part of the LEDs are slower and/or part of the LEDs are the same as the rate of the LCD. It is also to be understood that the image characteristics may be local in the two dimensional sense or local in the temporal sense, or both.

In order to perform the black point insertion, one technique would be to modify the input image data to the system in such a manner that the display tends to incorporate a generally more suitable black point. While such a technique may provide a modest improvement, it is preferable that the controller and software within the display itself perform the black point insertion.

As previously described, in some cases it is advantageous to provide multiple (e.g., 4) different black point insertions during each cycle. The desire for such a capability comes from wanting to shape the temporal signature of the overall light output waveform (at given local image area). The temporal waveform can be spectrally shaped to provide a visually-optimized temporal waveform that maximizes motion sharpness while minimizing flicker. For example, double-modulations per field may help in shifting flicker to very high temporal frequencies. In the case of one modulation per display frame, having one sub-frame be at the desired black level, and the others as gradual transitions can prevent the side-lobes of higher temporal frequencies which would occur if one had the black-point waveform be a simple rect function.

While the black point insertions may be inserted at any point in time, it is advantageous to insert the black points with the changes in the LCD and LED on a pixel by pixel basis.

While LED black point insertion is advantageous, it sometimes results in excess loss of light as a result. In order to improve the brightness of the display it may be advantageous for some displays to overdrive the LEDs to compensate for the loss of light as a result of the black point insertion. Accordingly, depending on the black point inserted for a particular pixel, region, or frame, the LEDs may be driven accordingly to compensate in some manner for the desired brightness of the display.

For some implementations there is a desire to use simultaneous pulse width and current level modulation within the same frame. The purpose is to have localized image-dependent variable-level black level insertion. The system may consider the fact that no motion blur occurs in certain image areas due to smoothness, and that no motion blur is visible in certain image areas due to the mean local gray level (a consequence of CSF having lower bandwidth as light level reduces), and that flicker visibility can be lessened if it is not full-field, and that brightness loss can be minimized if black point insertion is not always on (i.e., spatially and temporally).

In some implementations there is a desire to time synch the start of the LED matrix update with the start and end of the LCD update, which may or may not be in phase with the LCD.

The control system for the LED backlight in some implementations should be capable of splitting a control signal (e.g., an 8 bit control signal) (such as carried by "dummy" line of image data) so that x bits are used for amplitude control of the actual black level, and the remaining bits are used to select which of the n sub-fields the amplitude control is applied to.

A further implementation may use subfields to make dark regions darker. (The principal motivation for such an implementation relates to the use of subfields to make the backlight flash for motion blur removal. To preserve maximum (or significant) white the system may turn off the flashing to all subfields are static white areas to preserve the maximum white value. Some implementations may not include LED levels below some minimum value, such as 16 or less. Accordingly, the code value of 17 becomes the darkest level in such a case. However, one can actually write the level of zero, which provides a good black image (even when viewed in dark room). But assuming that the minimum code value is then 17, which does not provide a good solid black level. Trying to use 0 results in the tonescale also falling on levels 1-16 (which may cause the display to flash). So a modification may include using the subfields of the backlight to give some of the key black levels between 1 and 16. That is, by turning them off to create lower luminance level than you get at value 17.

One implementation may use the sub-fields to get darker values (say a display where the LED allows a min level when on, and a totally off level when not engaged—this is common since the V-I curve of LED has a unstable region near zero, but not zero). Also, to provide better gray level resolution in the dark areas (e.g., the one described that has a significant step from 0 to 16, then the rest of the display has single code value resolution).

The present inventors considered the architecture of using white light emitting elements, light as light emitting diodes, together with a liquid crystal material that includes colored filters on the front thereof. After considering this architecture, the present inventors concluded that at least a portion of the color aspects of the display may be achieved by the backlight, namely, be replacing the 2-dimensional light emitting array of elements with colored light emitting elements. The colored light emitting elements may be any suitable color, such as for example, red, blue, and green.

One or more colored light emitting elements may be modified in illumination level (from fully on, to an intermediate level, to fully off) to correspond with one or more pixel regions of the liquid crystal material together. The traditional colored filters may be used, or otherwise the colored filters may be removed. The colored light emitting elements may have a spatial density lower than the density of the pixels of the display, which would permit some general regional image differences. The colored light emitting elements may have a density the same as the density of the pixels of the display, which would permit modification of a color aspect of each color on a more local basis. The colored light emitting elements may have a density greater than the density of the pixels of the display, which would permit modification of the color aspect of individual subpixels or otherwise small groups of pixels. In addition, a set of light emitting elements (a density greater than, less than, or the same as the density of the pixels) that are capable of selectively providing different colors may be used, such as a light emitting diode that can provide red, blue, and green light in a sequential manner. In addition, both colored light emitting diodes together with white light emitting diodes may be used, where the white light emitting diodes are primarily used to add luminance to the display.

The 2-dimensional spatial array of colored light emitting diodes may be used to expand the color gamut over that which would readily be available from a white light emitting diode. In addition, by appropriate selection of the light emitting diodes the color gamut of the display may be effectively controlled, such as increasing the color gamut. In addition, the different colors of light tend to twist different amounts when passing through the liquid crystal material. Traditionally, the "twist" of the liquid crystal material is set to an "average" wavelength (e.g., color). With colors from light emitting diodes having a known general color characteristic, the "twist" (e.g., voltage applied) of the liquid crystal material may be modified so that it is different than it otherwise would have been. In this manner, the colors provided from the liquid crystal material will be closer to the desirable colors. The colors may also be filtered by the color filters, if they are included.

In some cases, there are small defects in regions of the display, such as a defect in the liquid crystal material. For example, the defect may be that that pixel is always on, off, or at some intermediate level. The present inventors came to the further realization that by spatially modulating the light emitting diodes in modified manner may effectively hide the defect in the pixel. For example, if one pixel is "stuck on", then the light emitting diode corresponding to that pixel may be turned "off" so that the pixel is no longer emitting significant light on a "stuck on" mode. For example, if one pixel is "stuck off", then the light emitting diodes proximate to that pixel may be selectively modified so that the "stuck off" pixel is no longer as noticeable.

The color gamut of the display may be increased by using a plurality of different colored light emitting diodes having a collective color gamut greater than the typical white light emitting diode. In addition, the selection of the color filters provided with respective pixels, if included, may be selected to take advantage of the wider color gamut provided by the colored light emitting diodes. For example, the blue light emitting diode may have a significant luminance in a deeper blue color than a corresponding white light emitting diode, and accordingly the blue filter may be provided with a greater pass band in the deeper blue color.

The light emitting diodes may be provided with a suitable pattern across the 2-dimensional array, such as a Bayer pattern. With a patterned array of light emitting diodes, the signal provided to illuminate the pattern of light emitting diodes may be sub-sampled in a manner to maintain high luminance resolution while attenuating high frequency chromatic information from the image information.

In some cases, the density of available color light emitting diode backlights may have a relatively low density in comparison to the light emitting diodes. In order to achieve a full colored display with a greater density, a field sequential modulation of the backlight may be used. In this manner, a blue sub-field, a green sub-field, and a red sub-field may be presented to achieve a single image. For further illumination, a white sub-field may be used to increase the overall illumination.

In some cases, a black point insertion may be used to improve the image quality. In addition to turning on/intermediate level/off the light emitting diodes in the case of colored light emitting diodes to achieve black point insertion, the different colored light emitting diodes may be turned on/intermediate/off to different levels to achieve different effects.

In some cases it may be desirable to modulate the intensity of the different colored back lights in accordance with the luminance of the red, green, and blue signals. Accordingly, the overall luminance of a pixel is used to provide the same, or a substantially uniform, luminance to each of a red, green, and blue light emitting elements. This may result in a boost in the luminance dynamic range and resulting color artifacts of the display being relatively straightforward to manage, but may unfortunately tend to result in less color in the shadows of an image. Another manner of modulating the intensity of the different colored back lights is to provide a color intensity to each of the red, green, and blue light emitting elements in accordance with the intensity of the corresponding pixel(s). This may result in an increase in chromatic artifacts but will end to providing "fuller" colors.

In some cases, it is desirable to include the combination of colored light emitting diodes, black point insertion, and modulation of the intensity of the black point insertion and/or the luminance of the light emitting diodes. Moreover, sequential color fields may likewise be used, such as for example, red field, blue field, and green field presented in a sequential manner.

All the references cited herein are incorporated by reference.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

What is claimed is:

1. A method for displaying an image on a liquid crystal display comprising:

(a) illuminating a first pixel at a first non-zero illumination level during an initial frame;

(b) illuminating said first pixel at a second non-zero illumination level during a subsequent frame, wherein said subsequent frame is temporally later than said initial frame;

(c) wherein said first pixel is selectively decreased in illumination to an intermediate illumination level, where the luminance magnitude of said intermediate illumination level, maintained over an interval beginning after illuminating said first pixel during said initial frame and ending before illuminating said first pixel during said subsequent frame, is automatically selected based upon a predicted amount of temporal blur, prediction of said temporal blur being based on measurements of an input image signal limited to a region local to said first pixel, measured after modifying said input image signal by a point spread function of a backlight of said display as modified by a diffusion layer, said point spread function stored in memory accessible to said display.

2. The method of claim 1 wherein said intermediate illumination level is less than that which said first pixel is otherwise illuminated to achieve said second illumination level.

3. The method of claim 1 wherein said intermediate illumination level is substantially zero.

4. The method of claim 1 wherein the selective decrease in illumination to an intermediate illumination level, resulting from said predicted amount of temporal blur, is isolated to said region.

5. The method of claim 1 wherein said temporal blur is based upon moving edges.

6. The method of claim 1 wherein said temporal blur is based upon content of at least one of said frames.

7. A method for displaying an image on a liquid crystal display comprising:

(a) illuminating a first pixel at non-zero illumination levels during a plurality of different frames;

(b) wherein said first pixel is decreased in illumination to a decreased illumination level having a luminance magnitude, maintained over an interval beginning after illuminating said first pixel during said initial frame and ending before illuminating said first pixel during a next subsequent frame, automatically selected based upon a predicted amount of temporal blur, prediction of said temporal blur being based on measurements of an input image signal limited to a region local to said first pixel, measured after modifying said input image signal by a point spread function of a backlight of said display as modified by a diffusion layer, said point spread function stored in memory accessible to said display.

8. The method of claim 7 wherein the decrease in illumination to an intermediate illumination level, resulting from said predicted amount of temporal blur, is isolated to said region.

9. The method of claim 7 wherein said decreased illumination level is substantially zero.

10. The method of claim 7 wherein said temporal blur is based upon moving edges.

11. The method of claim 7 wherein said temporal blur is based upon content of at least one of said frames.

12. A method for displaying an image on a liquid crystal display comprising:

(a) illuminating a first pixel at non-zero illumination levels during a plurality of different frames;

(b) wherein said first pixel is periodically decreased in illumination to a value substantially near zero during at least one first interval between a respective pair of said plurality of frames, and where said first pixel is not decreased in illumination to said value substantially near zero during at least one second interval between a respective pair of said respective plurality of frames based upon a predicted amount of temporal blur, prediction of said temporal blur being based on measurements of an input image signal limited to a region local to said first pixel, measured after modifying said input image signal by a point spread function of a backlight of said display as modified by a diffusion layer, said point spread function stored in memory accessible to said display.

13. The method of claim 12 wherein said value is less than that which said first pixel is otherwise illuminated to achieve a next frame.

14. The method of claim 12 wherein said value is substantially zero.

15. The method of claim 12 wherein the decrease in illumination to an intermediate illumination level, resulting from said predicted amount of temporal blur, is isolated to said region.

16. The method of claim 12 wherein said temporal blur is based upon moving edges.

17. The method of claim 12 wherein said temporal blur is based upon content of at least one of said frames.

* * * * *

UNITED STATES PATENT AND TRADEMARK OFFICE

CERTIFICATE OF CORRECTION

PATENT NO. : 7,872,631 B2
APPLICATION NO. : 10/966979
DATED : January 18, 2011
INVENTOR(S) : Xiao-fan Feng et al.

It is certified that error appears in the above-identified patent and that said Letters Patent is hereby corrected as shown below:

On the Title Page:

Related U.S. Application Data

Item (60) Change "Provisional application No. 60/568,433, filed Apr. 5, 2004" to read --Provisional application No. 60/568,433, filed on May 4, 2004--.

Signed and Sealed this
Thirty-first Day of May, 2011

David J. Kappos

David J. Kappos
*Director of the United States Patent and Trademark Office*